US008756060B2

(12) United States Patent
Mercado

(10) Patent No.: US 8,756,060 B2
(45) Date of Patent: Jun. 17, 2014

(54) METHODS AND APPARATUS FOR AUDIO INPUT FOR CUSTOMIZATION OF DIGITAL DISPLAYS

(75) Inventor: Brennan Eul I. Mercado, Cagayan de Oro (PH)

(73) Assignee: NCR Corporation, Duluth, GA (US)

( * ) Notice: Subject to any disclaimer, the term of this patent is extended or adjusted under 35 U.S.C. 154(b) by 243 days.

(21) Appl. No.: 13/334,507

(22) Filed: Dec. 22, 2011

(65) Prior Publication Data

US 2013/0166302 A1 Jun. 27, 2013

(51) Int. Cl.
*G10L 21/00* (2013.01)

(52) U.S. Cl.
USPC ..... 704/251; 704/275

(58) Field of Classification Search
USPC ..... 704/275, 251
See application file for complete search history.

(56) References Cited

U.S. PATENT DOCUMENTS 6,085,195 A * 7/2000 Hoyt et al. ..... 1/1
6,804,537 B1 * 10/2004 Fujii ..... 455/557
6,847,336 B1 * 1/2005 Lemelson et al. ..... 345/8
6,965,868 B1 * 11/2005 Bednarek ..... 705/7.14
6,976,032 B1 * 12/2005 Hull et al. ..... 1/1
6,977,627 B1 12/2005 Dalton
7,080,028 B2 7/2006 Goodwin, III et al.
7,546,254 B2 * 6/2009 Bednarek ..... 705/26.1
7,636,456 B2 12/2009 Collins et al.
7,639,237 B2 * 12/2009 Perkins ..... 345/168
7,640,214 B2 12/2009 Black et al.
7,922,072 B2 4/2011 Hassenzahl
7,957,972 B2 6/2011 Huang et al.
8,005,673 B2 8/2011 Nagashima
8,011,571 B2 9/2011 Hurrell
8,033,461 B2 10/2011 Barron et al.
8,050,566 B2 11/2011 Luo et al.
8,066,273 B2 11/2011 Connell et al.
8,078,316 B2 12/2011 Blust et al.
8,078,912 B2 12/2011 Neilan et al.
8,296,183 B2 * 10/2012 Evans ..... 705/14.43
8,458,147 B2 * 6/2013 Payne et al. ..... 707/694
8,473,277 B2 * 6/2013 Jephcott ..... 704/3

* cited by examiner

*Primary Examiner* — Susan McFadden
(74) *Attorney, Agent, or Firm* — Peter H. Priest

(57) ABSTRACT

Aspects of customizing digital signage are addressed. For example, an audio feed may be analyzed for keywords occurring in potential customers' speech. These keywords are then employed to customize display screens of a digital display.

20 Claims, 4 Drawing Sheets

METHODS AND APPARATUS FOR AUDIO INPUT FOR CUSTOMIZATION OF DIGITAL DISPLAYS

FIELD OF THE INVENTION

The present application relates generally to digital displays, and more particularly to methods and apparatus for capturing and analyzing audio from potential customers in the vicinity of a digital display or elsewhere, and customizing the display content based upon the analysis of that audio.

BACKGROUND OF THE INVENTION

Fixed advertising display signs have been common for a great many years. With the advent of lower cost, large screen flat panel plasma and LCD displays, signs which can be controllably driven to change the content of their displays have become more and more prevalent in environments such as airports, retail stores, malls, train stations, multiplex movie theaters, sports arenas, and in general, in areas where large numbers of potential customers come and go on a regular basis. Typically, such displays loop through a predetermined sequence of advertisements so that after the loop has completed some small number of times, observers stop paying attention.

In addition, basic concepts of advertising have been evolving based upon the techniques employed by Internet based companies such as Google™, Facebook™ and the like. Greater emphasis is being placed on targeting advertising to individuals or to reflect current trends and topics of interest.

SUMMARY OF THE INVENTION

Among its several aspects, the present invention recognizes that innovative techniques developed by such companies may have raised the bar as to what kinds of advertising will catch the eyes of the younger generation. To such ends, aspects of the present invention provide improved techniques for advertising utilizing digital displays in which the display content is customized based on local trend data, as addressed further herein.

A more complete understanding of the present invention, as well as further features and advantages of the invention, will be apparent from the following Detailed Description and the accompanying drawings.

DETAILED DESCRIPTION

Figure 1A:
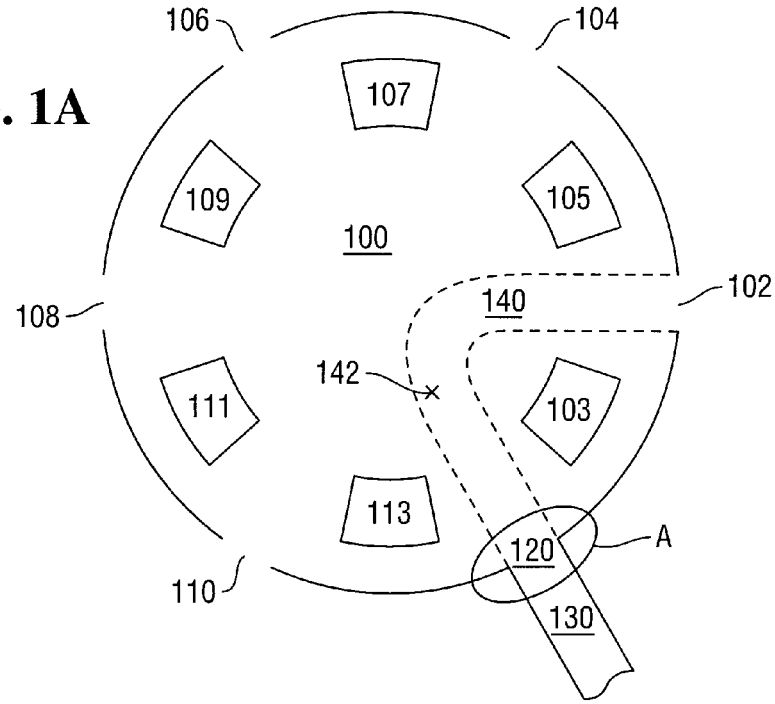
FIG. 1A illustrates a typical airport gate area where signage according to the present invention may suitably be employed.

FIG. 1A illustrates an airport gate area 100 which is an example of one suitable environment for employing customized digital displays in accordance with the present invention. As is typical, planes arrive and depart at a series of gates, such as gates, 102, 104, 106, 108 and 110 of FIG. 1. Passengers come to and leave from the gate area 100, passing through a doorway or entryway 120, and using hallway 130 to approach the gate area 100 or to depart therefrom as the case may be. While waiting for flights to depart, passengers sit in seating areas represented schematically in FIG. 1 by blocks 103, 105, 107, 109, 111 and 113. Businesses such as newsstands, snack shops, food stands, and the like (not shown), may also populate the gate area in a known manner.

As a result of the layout of gates, seating areas, airline assistance desks, shops, and the like, the majority of passengers travel from the fixed point of a gate doorway for a gate, such as gate 102, for example, on a typical or common pathway, such as pathway 140 (illustrated as the area between the dashed lines in FIG. 1A) from gate 102 to doorway 120.

Figure 1B:
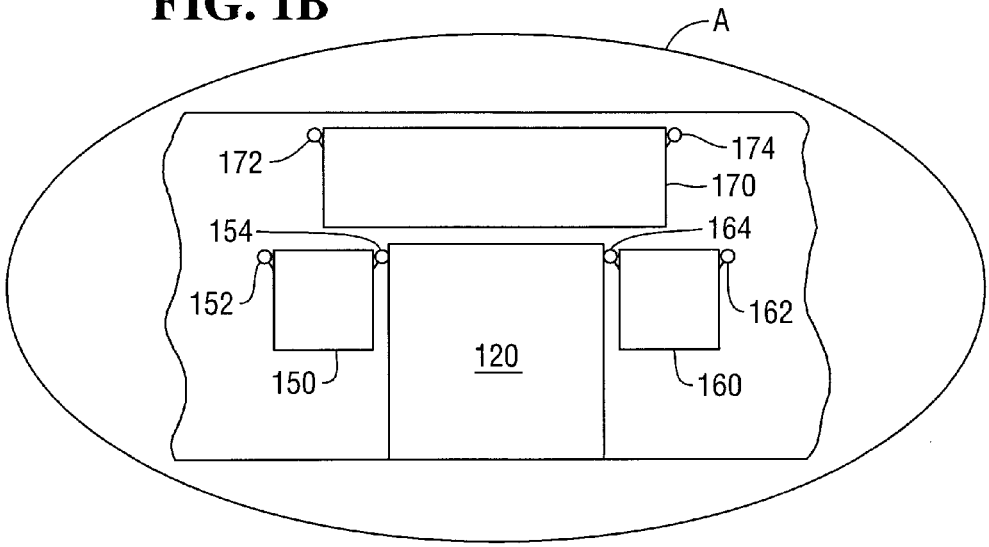
FIG. 1B shows a cutaway view of section A of the gate area of FIG. 1 where passengers enter the gate area or leave the gate area through a doorway or entryway where a digital sign, in accordance with the present invention, may be suitably employed.

As all of the passengers leaving gate area 100 leave by doorway 120, FIG. 1B shows an exemplary mounting arrangement of a display or displays in accordance with the present invention which is advantageous in the context of the gate area 100 illustrated in FIG. 1A. As seen in FIG. 1B, in one embodiment, a first display 150, in accordance with the present invention, is wall mounted to the left of doorway 120 and a second display 160, in accordance with the present invention, is wall mounted to the right of doorway 120. Displays 150 and 160 include microphones 152 and 162 and camera 154 and 164, respectively. In a second embodiment, a display 170 is wall mounted above the doorway 120. Display 170 includes microphone 172 and camera 174. The microphones 152, 162 and 172 may suitably be sensitive, omnidirectional microphones for picking up conversations from waiting passengers. All of the displays 150, 160 and 170 are advantageously mounted at a position at which a large number of people will pass by on foot and from which these displays can readily monitor and analyze words spoken by these people prior to their reaching the point at which they pass the displays. As a result, the display screens on the display can be customized as addressed further below.

Figure 2:
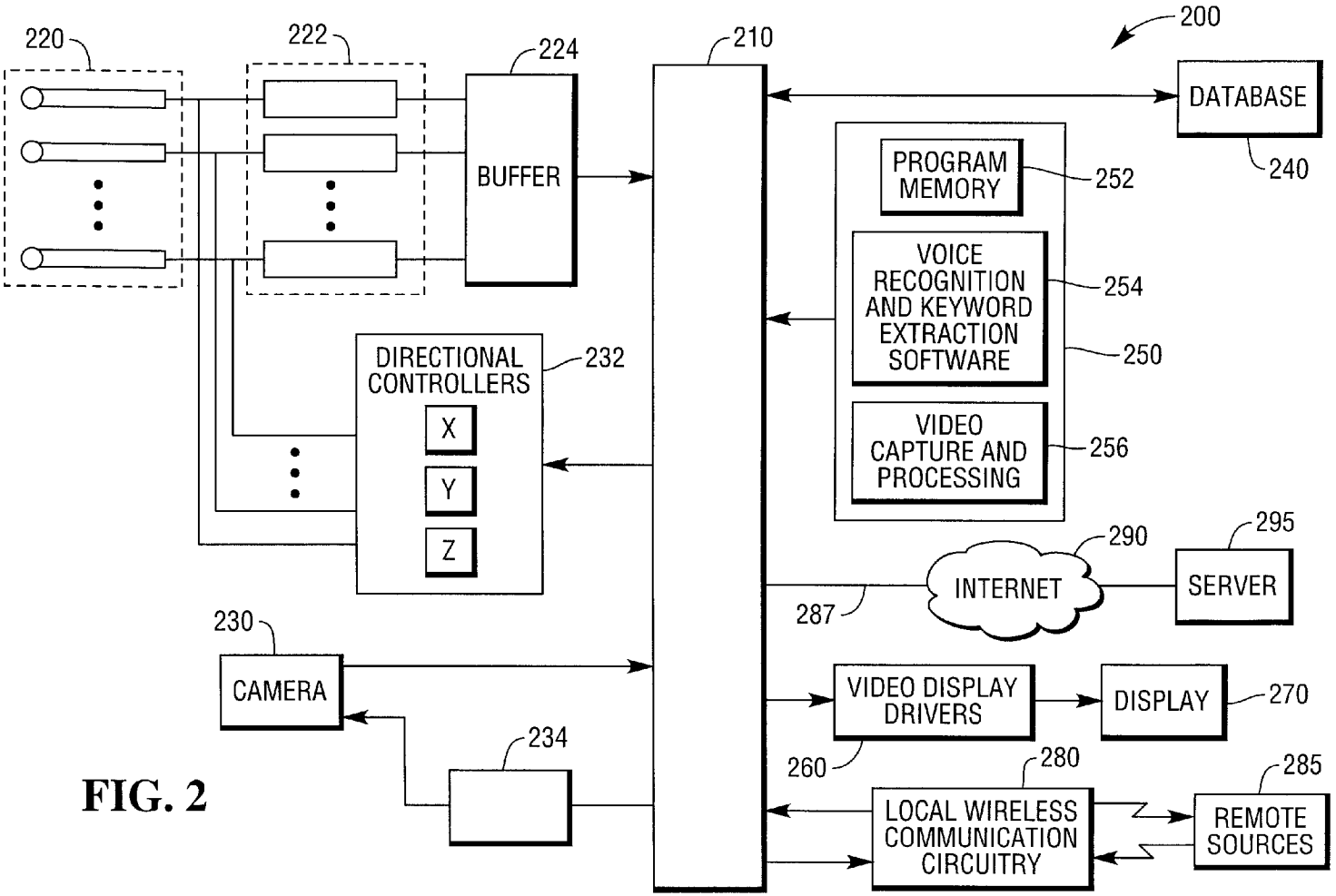
FIG. 2 shows an exemplary circuit diagram of one embodiment of a digital display system according to the present invention.

FIG. 2 illustrates a circuit diagram for an illustrative embodiment of a controller 200 for controlling displays, such as the displays of FIG. 1B. As seen in FIG. 2, control circuit 200 may suitably include a programmed microprocessor 210 which receives audio signal inputs from one or more microphones 220, $\mathbf{220}_1$, $\mathbf{220}_2$, . . . $\mathbf{220}_n$ (collectively 220). Where plural microphones are employed, each analog signal output may be passed through a noise filter 222, $\mathbf{222}_1$, $\mathbf{222}_2$, . . . $\mathbf{222}_n$ (collectively 222) buffered by a buffer 224 and the outputs of the buffer is then provided to microprocessor 210. Multiplexing may be provided as needed by a particular sign design environment.

As also seen in FIG. 2, while microphones 152, 162 and 172 of FIG. 1B may have a fixed focus of sound pickup, microprocessor 210 may be suitably programmed to drive directional controllers 232 each of which comprises x, y, and z controllers to adjustably control the direction and focus of each of the microphones 220 as described further below.

A camera or cameras provide video input signals to microprocessor 210. Filtering and buffering, as well as multiplexing, (not shown) may also suitably be provided for each of the cameras 230. As was the case for the microphones 220, while the cameras 154, 164 and 174 of FIG. 1B may have a fixed focus such as the doorways to the gates 102-110 or a point such as point "x" 142 on pathway 140, the microprocessor 210 may also be suitably programmed to controllably drive a directional controller 234 for each of the cameras 230. While separate microphone directional controllers 232 and camera directional controllers 234 are shown, it will be recognized that an integrated camera with a directional microphone may be adjusted by a single directional controller. Further, while cameras 230 are shown in FIG. 2 and described further herein, it will be recognized that other sensors might be employed such as optical sensors or infrared sensors used to simply detect a passenger, a change indicative of passenger movement, determine how long a passenger is standing near a sign, or the like.

Microprocessor 210 stores data in database 240, as well as, retrieving data therefrom. For example, database 240 may store a wide array of targeted advertisements and content from which microprocessor 210 selects content to create a custom display on display 270 as addressed further below. Memory 250 includes general program memory 252 for controlling operation of microprocessor 210, as well as, specialized voice recognition and keyword extraction and analysis software 254 and video capture and processing software 256. Microprocessor 210 provides control outputs to video display drivers 260 which in turn controls the digital display 270 which is suitable for use as any of the customized displays in FIG. 1B.

While FIG. 2 shows one embodiment of the present invention, it will be recognized that a wide number of variations are possible based upon the teachings herein. As one example, while microphones 220 and cameras 230 are shown connected by wires to microprocessor 210, local wireless communication circuitry 280 may be employed to receive wireless inputs from remote sources 285, such as microphones, cameras, or the like, which wirelessly communicate therewith. Further, an Internet connection 287 may be employed to connect the processor to the Internet 290 and one or more remote servers 295 so that database advertising content may be updated on a regular basis, remote trend data may be received, and the like.

Figure 3:
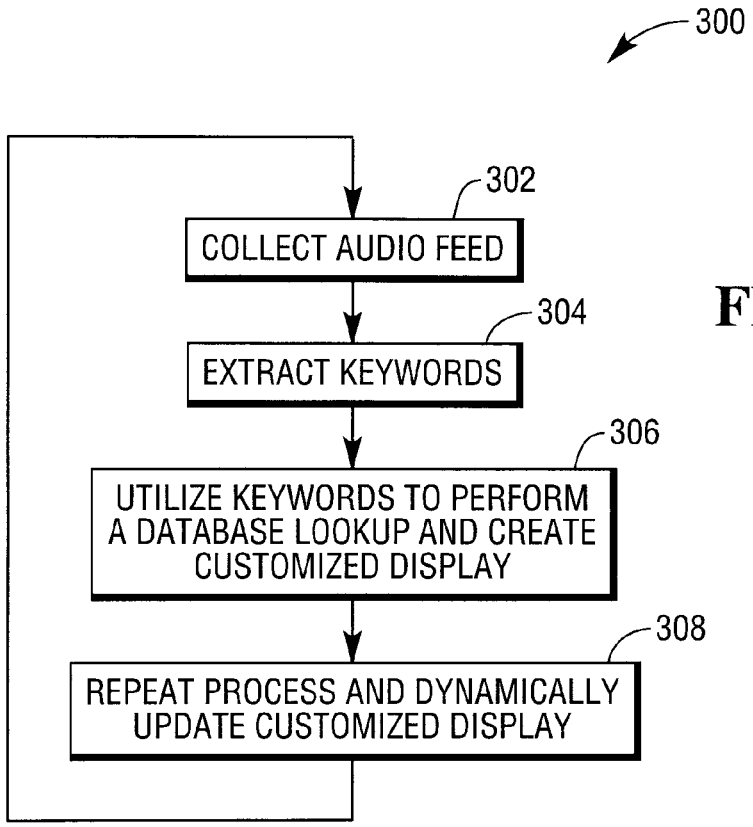
FIG. 3 shows a process of controlling a display system in accordance with the present invention.

FIG. 3 shows a process 300 for providing a customized digital display in accordance with the present invention. Process 300 begins by collecting raw local data such as an audio feed, including local trend data, in step 302. For example, a microphone or microphones 220 may be directed to pick up an audio feed, such as the conversations of arriving passengers, from the vicinities of one or more of the gates 102-120. In one embodiment, microprocessor 210 may receive updated arrival data through its Internet connection 287 and drive microphone directional controllers 232 to direct microphones 220 to cover the area for the next gate at which passengers will be arriving, for example, gate 102. A camera or cameras 230 may also be controlled by the directional controllers 234 to either focus on the same area as the microphones 220 or at a point closer to the digital sign, such as the point "x" 142 on pathway 142 to take a picture or video of a passenger or passengers approaching doorway 120 and the display or displays 150, 160 or 170 arranged by that doorway.

In step 304, the raw local data from step 302 is processed to extract local trend data, such as keywords contained therein. For example, audio signals from microphones 220 are filtered, buffered and fed to microprocessor 210. Where several microphones are employed, the outputs may be multiplexed. Microprocessor 210 then utilizes voice recognition software 254 which may suitably include keyword extraction software to extract keywords. Further details of voice recognition and word extraction are found in U.S. Pat. Nos. 8,050,566, 8,005,673, and 7,957,972, for example, which are incorporated by reference herein in their entirety. These keywords are analyzed and local trend data is extracted and stored, for example, in database 240. An illustrative example of this approach is provided below in connection with the discussion of FIG. 4. Video capture and processing software 256 may be suitably employed to process outputs from the cameras 230.

In step 306, the local trend data is utilized to create a customized display. For example, the keywords extracted in step 304 may be used to perform in a database look up. More specifically, based on the trend data stored in database 240, microprocessor 210 looks up customized and other content, and drives video display drivers 260 to cause display 270 to display a customized display screen. The illustrative example below discussed in connection with FIG. 4 provides further exemplary details of such customization.

In step 308, the process 300 loops back up to step 302. Further raw local data is collected and processed to extract local trend data. That data is processed and the customized display is dynamically updated in a customized manner. It will be recognized that a standard loop of content may be displayed with customized display screens like those described herein added on a predetermined basis, such as one custom display screen per every standard loop display screen.

Figure 4:
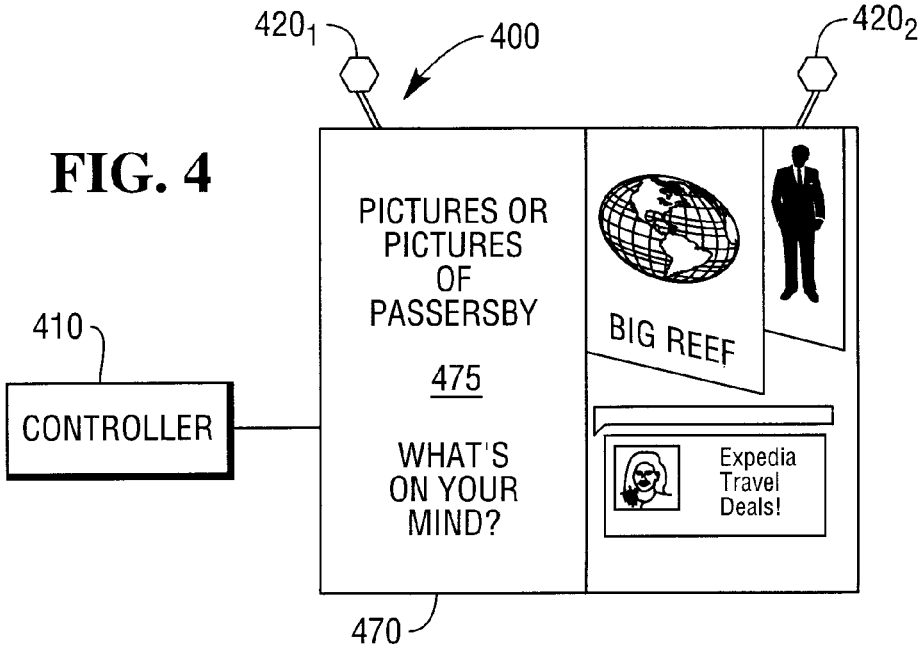
FIG. 4 shows an exemplary screen shot of a digital sign of FIG. 1B or a digital display system as in FIG. 2.

FIG. 4 shows an exemplary screen shot for a digital sign, such as the digital signs of FIGS. 1B and 2. FIG. 4 shows a digital display system 400 comprising controller 410 and display 470 which employs microphones $\mathbf{420}_1$ and $\mathbf{420}_2$, and which is displaying an exemplary customized display screen 475 therein. Display screen 475 includes a portion with a picture or pictures of passersby, a textual prompt, a movie advertisement and a travel advertisement with a celebrity photo, or the like.

In the example shown, two passengers have deplaned at gate 102 and microphone 400 for that gate has picked up one passenger saying " . . . I'm so digging Justin Bieber", and a second passenger responding " . . . man, my legs are still hurting from hiking yesterday, but the view . . . ." From this audio feed, keywords "hiking" and "Bieber" have been extracted and a database look up for hiking and Bieber is performed yielding possible display content for "Colorado", "North Face™", "iTunes™", "Bieber", "Expedia™", "Merrell™", and the like.

From these results, controller 410 makes a selection using a weighting approach, histogram techniques or other logic driven approaches to analyze the search results and produce a screen like the right hand portions of screen 475. To potentially spur user participation, a picture of a passerby or passersby and a textual prompt like "What's on your mind?" may be employed to increase user interest and participation. The picture or pictures may suitably be taken by a camera like cameras 152, 162 or 172 of FIG. 1B or 220 of FIG. 2.

Figure 5:
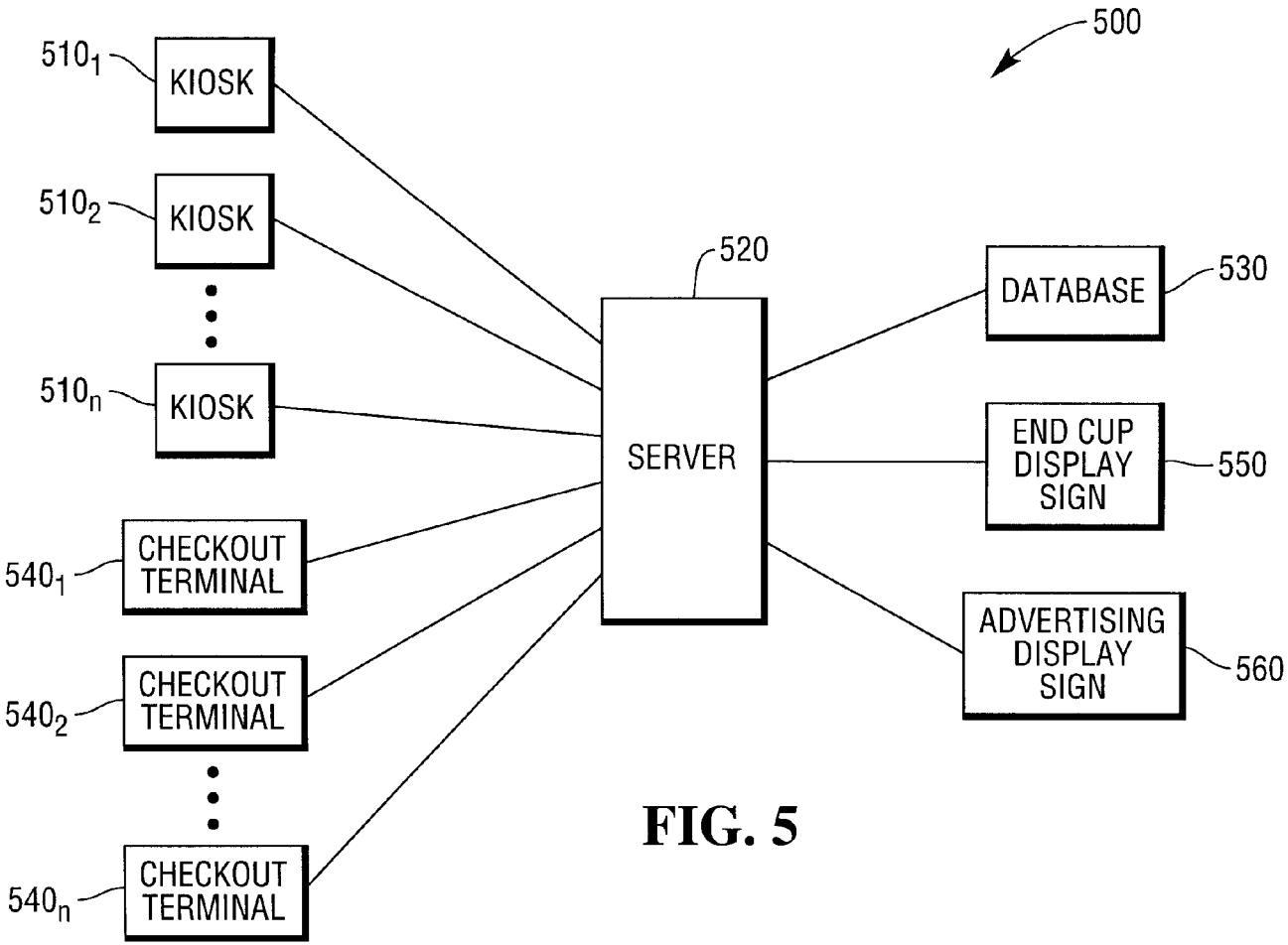
FIG. 5 shows a further embodiment of the present invention.

FIG. 5 shows an alternative embodiment of the present invention in which audio pickups from a variety of networked devices are employed to control displays in accordance with the present invention. In FIG. 5, a plurality of kiosks 510, $\mathbf{510}_1, \mathbf{510}_2, \ldots \mathbf{510}_n$ (collectively 510) and checkout terminals 540, $\mathbf{540}_1, \mathbf{540}_2, \ldots \mathbf{540}_n$ (collectively 540) in an environment such as a retail store are networked together. Each kiosk and terminal may include an audio pick up device such as a microphone and a display. Exemplary kiosks and terminals are shown in U.S. Pat. Nos. 8,078,912, 8,078,316, 8,066,273, 8,033,461, 8,011,571, 7,922,072, and 7,640,214 all of which are assigned to the assignee of the present invention and incorporated by reference herein in their entirety. It will be understood that such kiosks and terminals may be updated if necessary to include components like those shown in FIG. 2, for example, such as a microphone, a camera, an advertising database, appropriate software, and the like. A processor in each kiosk and terminal may extract relevant keywords. Alternatively, a central server 520 may perform said extraction. It will be recognized various approaches may be applied, but one extraction approach is to employ basic semantic rules programmed in software to eliminate, prepositions, verbs, adverbs, articles, and adjectives, so that only nouns are retained and analyzed. Alternatively, the system 400 could also directly look up nouns based on a "keyword tag cloud" or another look up based approach, and, while nouns are addressed herein, an adjective like "hungry" or other keywords may also be extracted and analyzed.

The extracted keywords are then added to a queue maintained by the central server 520. To determine the "hot topic" of the moment, the system 500 may suitably conduct a poll based on the number of times each keyword is "heard" by the system 500. The "hot topics" or the keywords with the most occurrences, are then matched to a database of advertisements in database 530 of the system 500. Based upon a software driven analysis of these results, the server 520 selects what advertisements to display on digital displays, such as end cap display sign 550, advertising display sign 560 or any of the kiosk or terminal displays not in use at that given instant. System 500 may also communicate with and tap a remote database from a third party advertisement provider for wider scope and additional content.

When the display of a kiosk or terminal is not in use, it may be employed to display customized advertising. Similarly, end cap displays, such as a display which regularly loop through a predefined playlist may be utilized to display a customized display or displays in place of one or more of the predetermined playlist screens if a keyword is used more than a predetermined number of times.

Among its several aspects, the present invention provides digital signage which displays advertisements that have more value based on context provided by local consumers. The ads may spark "crowd buying" as a result of informing potential consumers of "trending products" based on the conversations of the majority. Further, data generated may enlighten suppliers as to whether they are generating enough buzz especially in crowded places. Analysis of the public audio feed can provide a list of topics that would also allow the business establishments to effectively realign their marketing endeavors based upon immediate or near immediate feedback. Such a approaches provide a basis for differentiating from other typical prior art multimedia displays. Further, revenues can be generated by offering the customization of the present invention as an additional feature of digital displays in environments, such as retail chains where a display can be used for advertising when not used for another primary purpose, such as a video rental kiosk display or a vending machine display.

While the present invention has been disclosed primarily in the context of an airport gate area and a retail store, consistent with the claims which follow, it will be recognized that the invention may be suitably applied to a wide range of other public environments where large numbers of people are coming and going on a regular basis and the usage of signs to provide information to them is typical. Further, examples of raw data pick-up devices and methods of their control are addressed herein, but it will be recognized many changes or additions may be made in components and control as technology evolves and various technologies become cost effective.

I claim:

1. A customized digital display sign comprising:

a display mounted at a position at which people will pass by;

a microphone for generating an audio input signal from speech of a public speaker;

a processor for analyzing the audio input signal; and a display driver for driving the display, wherein the processor controls the display driver to drive the display to display a customized display screen based upon said analyzing.

2. The customized digital display of claim 1 further comprising:

a database storing advertising content, and wherein the customized display screen includes content retrieved from said database.

3. The customized digital display of claim 2 further comprising:

software for extracting keywords from the audio input signal and for utilizing said keywords to look up the content retrieved from said database.

4. The customized digital display sign of claim 1 further comprising:

a camera for obtaining an image of the public speaker, and wherein the image is displayed on the display.

5. The customized digital display sign of claim 4, wherein a textual prompt is displayed proximate the image of the public speaker.

6. The customized digital display sign of claim 1 further comprising:

a plurality of kiosks including microphones for picking up speech of further public speakers, the plurality of kiosks networked with the customized digital display sign.

7. The customized digital display sign of claim 1 further comprising:

directional controllers driven by the processor to adjustably control a pickup area of focus for the microphone.

8. The customized digital display sign of claim 1 further comprising:

local database storage connected to the processor; and an Internet connection connecting the processor to a remote server, and wherein digital display content is downloaded from the remote server to the local database storage.

9. The customized digital display sign of claim 1, wherein the local database storage stores advertising content which displays in a sequential loop in the absence of detection of speech of a public speaker.

10. The customized digital display of claim 1 wherein the public speaker is in a public area adjacent the display, and the microphone picks up speech of the public speaker while in said public area.

11. The customized digital display of claim 10 further comprising multiple microphones at least one of which has an adjustable direction and focus controlled by the processor.

12. The customized digital display of claim 11 wherein the display further comprises a camera having a directional controller driven by the processor.

13. A method of providing a customized digital display sign on a public digital display comprising:

generating an audio input signal from speech of a public speaker utilizing a microphone;

analyzing the audio input signal utilizing a processor; and driving a display, mounted at a position at which people will pass by, with a display driver controlled by the processor, wherein the processor controls the display driver to drive the display to display a customized display screen based upon said analyzing.

14. The method of claim 13 further comprising:

storing advertising content in a database, wherein the customized display screen includes content retrieved from said database.

15. The customized digital display of claim 14 further comprising:

extracting keywords from the audio input signal utilizing software; and utilizing said keywords to look up the content retrieved from said database.

16. The customized digital display sign of claim 13 further comprising:

obtaining an image of the public speaker utilizing a camera; and displaying the image on the display.

17. The method of claim 16 further comprising:

displaying a textual prompt proximate the image of the public speaker.

18. The method of claim 13 further comprising:

utilizing a plurality of kiosks including microphones to pick up speech of further public speakers, the plurality of kiosks networked with the customized digital display sign.

19. The method of claim 13 further comprising:

adjusting a pickup area of focus for the microphone utilizing directional controllers driven by the processor.

20. The method of claim 13 further comprising:

connecting the processor to a remote server utilizing an Internet connection; and downloading digital display content from the remote server to a local database storage connected to the processor.

* * * * *